United States Patent [19]

Takeda et al.

[11] Patent Number: 4,818,148

[45] Date of Patent: Apr. 4, 1989

[54] FROST DAMAGE PROOFED PILE

[75] Inventors: Takashi Takeda, Kanagawa; Katsumi Omori, Yokohama; Toshiyuki Ohkuma; Kenji Kidera, both of Kawasaki; Shigeru Nakagawa, Yokohama; Tetsuzo Hirose, Kanagawa, all of Japan

[73] Assignee: Nippon Kokan Kabushiki Kaisha, Tokyo, Japan

[21] Appl. No.: 164,967

[22] Filed: Mar. 7, 1988

Related U.S. Application Data

[63] Continuation of Ser. No. 862,274, May 12, 1986.

[30] Foreign Application Priority Data

| | | | |
|---|---|---|---|
| May 14, 1985 | [JP] | Japan | 60-100429 |
| May 14, 1985 | [JP] | Japan | 60-100430 |
| May 14, 1985 | [JP] | Japan | 60-100431 |
| May 14, 1985 | [JP] | Japan | 60-100432 |

[51] Int. Cl.[4] ..... E02D 5/60

[52] U.S. Cl. ..... 405/234; 405/231; 405/232; 405/216

[58] Field of Search ..... 405/231, 232, 234, 216; 52/728, 515

[56] References Cited

U.S. PATENT DOCUMENTS

| | | | |
|---|---|---|---|
| 761,721 | 6/1904 | Stanley | 405/216 X |
| 1,124,955 | 1/1915 | Ripley | 405/216 X |
| 2,700,875 | 2/1955 | Miller | 405/253 |
| 2,724,156 | 11/1955 | Shaw | 52/728 X |
| 3,496,729 | 2/1970 | Pleuger | 405/257 |
| 3,630,037 | 12/1971 | Howard | 405/231 |
| 3,706,204 | 12/1972 | Long | 405/234 X |
| 3,921,410 | 11/1975 | Philo | 405/234 X |
| 4,019,301 | 4/1977 | Fox | 405/216 X |
| 4,124,483 | 11/1978 | Christenson | 405/232 X |
| 4,157,287 | 6/1979 | Christenson | 405/232 X |
| 4,244,156 | 1/1981 | Watts | 52/728 |
| 4,464,083 | 8/1984 | Wathey | 405/216 |
| 4,585,681 | 4/1986 | Kidera et al. | 405/231 X |

FOREIGN PATENT DOCUMENTS

| | | | |
|---|---|---|---|
| 1090714 | 10/1954 | France | 405/243 |

*Primary Examiner*—Dennis L. Taylor

*Attorney, Agent, or Firm*—Fleit, Jacobson, Cohn & Price

[57] ABSTRACT

A covering is applied onto the outer surface of a pile including a steel pipe or the like to surround a predetermined length thereof so as to reduce a frost heaving force or negative friction acting on the pile in a frigid area. The covering is closely adhered by an adhesion layer the like to the pile over a given length thereof. This given length is between 0.5 and 5 m. The covering member includes a smooth-surfaced plastic covering or elastic covering. A rugged surface covering may be provided below the smooth surfaced covering.

11 Claims, 8 Drawing Sheets

FROST DAMAGE PROOFED PILE

This application is a continuation, of application Ser. No. 862,274, filed May 12, 1986.

BACKGROUND OF THE INVENTION

This invention relates to a pile foundation as structural foundation used in a frigid area and, more particularly to a frost damage proofed pile or pile secured against frost damage.

When a rack for a pipeline or a similar structure is installed in a frigid area such as permafrost area or seasonally frozen soil area, it is essential to a protect the structure against frost damage such as freezing, frost heaving or thawing and resulting ground subsidence. To this end, various construction methods have been resorted to, including using a piling foundation, which appears to be most popular.

By permafrost area is meant a terrain or area such as Alaska, Canada or Siberia where the soild layer frozen through the year, hereafter referred to as permafrost, is distributed and where the annually averaged temperature is lower than 0° C. By the active layer is meant the soil layer extending from the ground surface to the permafrost layer. The active layer is affected severely by seasonal changes in temperature and subjected to freezing and frost heaving during winter while being also subjected to thawing and ground subsidence during summer. By the seasonally frozen soil area is meant the terrain where the annually averaged temperature is higher than 0° C. The seasonally frozen soil area is devoid of the permafrost and subjected to freezing during winter and thawing during summer. In the following description, the seasonally frozen soil layer is used synonymously as the active layer.

The pile foundation used in a frigid area is embedded in the permafrost for supporting the weight of the superstructure and the frost heaving force and the negative friction on the basis of the adfreeze strength between the permafrost and the pile surface. To this end, it is essential to provide for a positive freezing strength between the pile and the permafrost and a sufficient length of pile embedment in the permafrost. However, the permafrost is not necessarily of uniform properties, but may have variable values of freezing strength, depending upon the soil property or temperature. Thus the structure may actually be subjected to frost damage even if the pile is embedded into the permafrost a distance designed to give a sufficient adfreeze strength. Thus it is required that a certain safety factor be taken into account when designing the pile length, thus causing disadvantages from the viewpoint of ease of construction and economy. There is a great need for an improved technique and system in setting piles in a frigid area.

U.S Pat. No 3,630,037 discloses a system of protecting a pile from frost heaving during the refreezing of the thawed portion of a permafrost by placing about the pile a rubber sleeve which is slightly longer than the thickness of the portion of the permafrost which melts and refreezes. Also, U.S. Pat. No. 4,585,681 (filed on June 26, 1984, Ser. No. 624,750) discloses a frost damage proofed pile in which the pile surface is covered with a tubular sheath member of a length and a portion of the length is formed as an extensible section which is defined by a series of ridges extending outwardly of the sheath member cross-section with respect to the longitudinal axis of the extensible section.

With the systems disclosed by these prior U.S. patents, a liquid must be sealed into the space between a pile and a rubber sleeve or sheath member and otherwise no effective frost heaving prevention can be obtained. As a result, the sleeve or the sheath member is secured at least only at its lower end to the pile and the greater part of its body portion is not secured to the pile. This requires that a special attention be given for example to the danger of the sleeve or the sheath member leaning or falling off when driving the pile into a bored hole in the ground.

SUMMARY OF THE INVENTION

The present invention has resulted from ardent studies made with a view to overcoming the foregoing deficiencies in the prior art and it is the primary object of the invention to provide a novel structure for a pile of the type which reduces the frost heaving force or the negative friction acting on the pile in a frigid area, the novel structure comprising a covering layer capable of reducing the effects of the frost heaving force and the negative friction on the pile including a steel pipe or the like and arranged so as to be adhered to the outer surface of the pile at least for its length greater than the thickness of the active layer thereby protecting the superstructure of the pile against frost damage and reducing the danger of the covering layer from leaning or falling off during the driving of the pile into a bored hole in the ground.

It is another object of the invention to provide a frost damage proofed pile including a plastic covering having a low-friction outer surface as its covering layer.

It is another object of the invention to provide a frost damage proofed pile inluding an elastic material covering as its covering layer.

In accordance with one aspect of the invention, a plastic covering is applied to closely adhere to the outer surface of a pile comprising a steel pipe or the like and the covering forms a smooth-surfaced fixed covering portion greater than a length corresponding to the thickness of the active layer. The plastic covering is adhered by adhesion layer means to the outer surface of the pile beyond a length corresponding to the thickness of the active layer and the adhesion layer means may for example be a layer of adhesive. According to a specific embodiment, the plastic covering is made of a plastic material of a relatively low coefficient of friction containing 1 wt. % or more polyfluoro-olefins such as polytrifluoroethylene or polytetrafluoroethylene. According to another embodiment, the plastic covering is made of a plastic material whose glass transition temperature is 0° C. or over. According to still another embodiment, an elastic covering is formed on the pile surface so as to be closely adhered to the pile. Also, in this case, the elastic covering is adhered by adhesion layer means to the pile surface beyond a length corresponding to the thickness of the active layer.

In any case, with the pile according to the invention, the length of the covering adhesion to the pile must be beyond the thickness of the active layer and the pile must be embedded in such a manner that the lower end of the covering is positioned near to or below the bottom region of the active layer or the seasonally frozen soil layer and its upper end is positioned above the ground surface. Thus, in view of the range of thicknesses of the ordinary active layers, the length of the covering adhesion is selected between 0.5 and 5 m.

In accordance with the invention, the adhesion layer means may be an adhesive having an adhesive force greater than a shear stress which may be expected to occur in the outer surface of the pile during the frost heaving.

Also, in accordance with the invention, the elastic material covering may be made of a material essentially consisting of an elastic material whose molecular chain has a net structure or a high-molecular weight elastic material whose main chain is composed of hard and soft segments.

Also, in accordance with a preferred modification of the invention, a covering having irregularities in its surface is adhered to the surface of the pile over a certain length of the pile portion positioned below the plastic or elastic covering attached to the pile or below the bottom region of the active layer or the seasonally frozen soil layer. This rugged covering may be formed as an integral part of the smooth-surfaced covering or the elastic covering positioned above it or as a separate covering. In accordance with this modified embodiment, the smooth covering is formed at the solid covering portion corresponding to the active layer thus ensuring a satisfactory frost heaving reducing effect by virtue of its low friction properties and moreover the covering formed with a rugged surface is provided at the portion corresponding to the permafrost with the resulting adfreeze strength increasing effect.

In other words, a pile formed on its surface with a solid covering composed of an upper smooth covering portion and a lower rugged covering portion ensures a satisfactory frost heaving preventing effect when used in the permafrost zone.

By using a frost damage proofed pile obtained according to the teachings of the invention, it is possible to expect the below-mentioned effects.

(1) The frost heaving force applied to the pile by the active layer is reduced considerably and therefore it satisfactorily protects a structure in the frigid area from frost damage.

(2) The frost heaving force acting on the pile is reduced with the result that the depth of embedment of the pile is reduced considerably and also the overall cost is reduced considerably in consideration of the maintenance.

(3) The pile is simple in construction and easy to manufacture. Moreover, the solid covering formed on the surface of the pile has a corrosion preventing effect and therefore the pile is suited for use over a long period.

(4) The pile is suited for mass production and it is also easy to pack and transport with the resulting reduction in the cost.

The above and other objects as well as advantageous features of the invention will become more clear from the following description taken in conjunction with the drawings.

DESCRIPTION OF PREFERRED EMBODIMENTS

Before describing preferred embodiments of the present invention, some of the methods used heretofore for reducing the frost heaving force acting on the pile foundation will be described.

Figure 1:
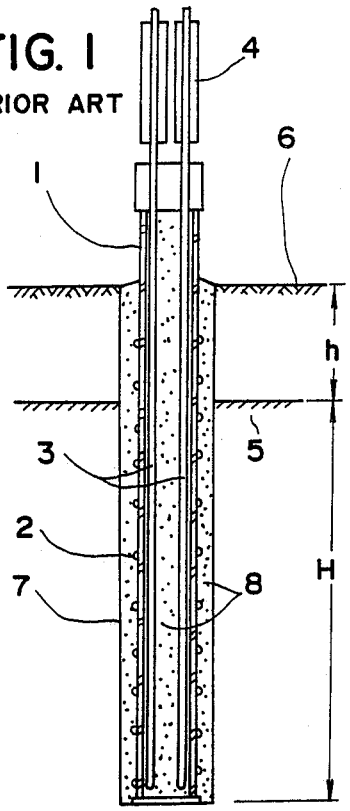
FIG. 1 PRIOR ART
FIGS. 1, *2a*, *2b* and 3 are diagramatic views showing different examples of prior art frost damage proofed piles.

Referring to FIGS. 1, *2a*, *2b* and 3, there are shown methods used heretofore in the permafrost area or in the seasonally frozen soil area for reducing the frost heaving force acting on the pile foundation. FIG. 1 shows a thermal pile system, while FIGS. *2a* and *2b* show an anti-frost-heaving pile and FIG. 3 an adfreeze strength augmenting pile system.

An example of the thermal pile system is shown in longitudinal section in FIG. 1, wherein the numeral 1 designates a pile, such as tubular steel pile or concrete pile, the numeral 2 an undulating member placed around pile 1 for improving adfreeze strength, the numeral 3 a heat pipe fitted within pile 1 and the numeral 4 a radiator. The numeral 5 designates a permafrost layer and the numeral 6 an active layer. The pile 1 is embedded in a hole 7 in the layers 6 and 5 and secured in place by backfill sand slurry 8. In the drawing, H designates the length of embedment of the pile 1 in the permafrost, and h the thickness of the active layer 6.

In the thermal pile system, as described above, heat is extracted from below the ground during winter by the action of the heat pipe 3 embedded in the permafrost 5 for reducing the thickness of the active layer subjected to thawing and freezing (thickness h of the active layer) for thereby improving the resistance to frost heaving. In addition, with the thermal pile system, described above, thawing of the permafrost around the pile 1 during summer is prevented from occurring because of solar radiation and the heat input from the superstructure. Thus, with the thermal pile system, there is no risk that the permafrost around the pile is thawed and subsided during summer thus causing negative friction to act on the pile, or that the soil is frozen during winter thus causing an excess frost heaving force to act on the pile.

However, with the thermal pile system, described above, it is not possible to drastically reduce the frost heaving force or negative friction, although the thickness h of the active soil layer 6 can thereby be reduced to some extent. Thus the system is not fully effective to prevent frost damage from occurring in the structure. For instance, during the first winter since installment of the thermal pile, the temperature in the deeper ground may be lowered so excessively that frost heaving amount becomes larger than in the case the thermal pile is not used, thus increasing the frost heaving force. From the second year on, the frost heaving force is increased possibly due to the lower temperature in the active layer 6 during winter. It is a conventional practice to increase the length of embedment H of the thermal pile in the permafrost for preventing frost damage. However, this is not desirable from the viewpoint of economy and increasing the ease of construction.

Figure 2A:
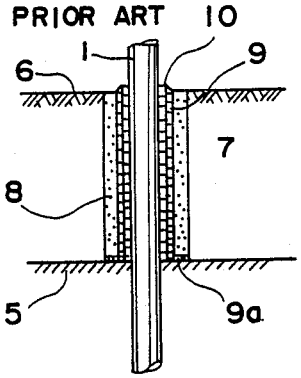
FIG. 2a PRIOR ART

In the anti-frost heaving pile system, the space delimited between the active layer and the peripheral surface of the pile is filled with a material capable of reducing the adhesion acting between the pile and the frozen soil. In an embodiment shown in FIG. 2*a*, a casing 9 is placed concentrically and externally of the pile 1 for providing a dual tube, and the space between the pile 1 and the casing 9 is filled with a mixture 10 of wax and oil of higher density, while the outer periphery of the casing 9 is surrounded by a backfill sand slurry 8 for effecting separation of the frost heaving force.

Figure 2B:
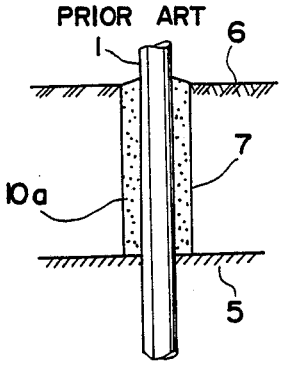
FIG. 2b PRIOR ART

The numeral 9*a* designates a flange provided to the lower end of the casing 9. In an embodiment shown in FIG. 2*b*, a material 10*a* consisting of a mixture of soil, oil and wax is used as back-filling material to be filled in a locating hole 7 in the active soil layer 6.

In the anti-frost-heaving system, described above, it is necessary that the mixture 10 be filled or back-filled about the periphery of the pile at the construction site with the aid of special machinery or apparatus and thus with additional costs and labor. Since the oil-wax mixture is fluid enough to be used at the construction site as back-filling material, there is the risk that the material be permeated or dispersed into the surrounding ground during summer, thus making it necessary to recharge the mixture. Moreover, the permanently frozen soil may be thawed during summer due to the freezing point depression thus causing the risk of environmental destruction. In addition, in the dual pipe system described above, the casing is caused to undergo alternate cycles of heaving or sinking as the result of the active layer becoming frozen or thawing, thus occasionally affecting the superstructure.

Figure 3:
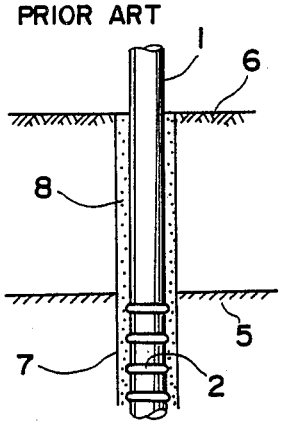
FIG. 3 PRIOR ART

In the freezing strength augmenting pile system, shown in FIG. 3, the portion of the pile 1 embedded in the permafrost 5 is provided with notches or undulations 2 for improving the adfreeze strength between the permafrost 5 and the pile 1 for providing resistance to the frost heaving force exerted by the active layer 6.

This system has however such an inconvenience that the permafrost surrounding the pile 1 is not necessarily of uniform quality and may have variable values of adfreeze strength. In addition, the frost heaving force is changed with the shape or intervals of the notches or undulations and thus considerable accuracy is required in machining the end portions of profiled steel sections in order to achieve a larger adfreeze strength.

Figure 4:
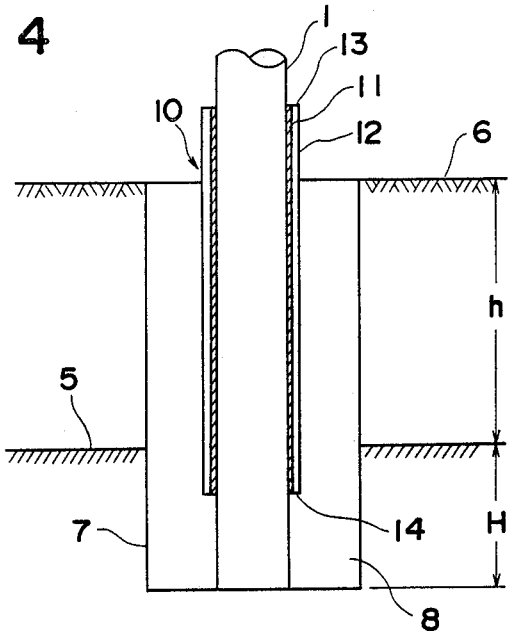
FIG. 4 is a sectional view of a frost damage proofed pile produced according to a first embodiment of the invention.

FIG. 4 shows a first embodiment of the present invention in longitudinal section. The parts same as those shown in FIGS. 1 to 3 are designated by the same numerals and the corresponding description is omitted for simplicity.

In the Figure, the numeral 1 designates a pile and a feature of the present invention resides in that an adhesive plastic layer 11 is formed on the surface of the pile 1 beyond a length corresponding to the thickness of an active layer 6 and a plastic layer 12 of a low friction is formed on the outer surface of the layer 11.

To reduce the frost heaving force to a greater extent, the plastic covering 12 should preferably be formed in such a manner that its lower end 14 is positioned near to or below the bottom region of the active layer 6 or a seasonally frozen soil layer 6 and its upper end 13 is positioned above the ground surface.

The adhesive plastic coating 11 is used to adhere or bring into close contact the pile or steel pipe 1 and the low-friction plastic covering 12 and it may be made of the plastic constituting the principal component of the low-friction plastic covering 12 or any modified material of such plastic.

The adhesion strength of the system including the pile, the adhesion layer and the low-friction layer must be large enough to overcome a shearing force which will be caused between the soil and the low friction layer due to frost heaving or thawing subsidence of the soil.

Also, the low-friction plastic covering 12 may be made, of materials comprising a thermoplastics such as poly-olefin, polyamide, thermal setting plastics such as epoxy resin with the addition of polyfluoro-olefins such as 1 wt. % or more of polytrifluoroethylene or polytetrafluoroethylene fine powder.

While, in this embodiment, it is conceivable to eliminate the use of the adhesion layer 11, this is not desirable since the adhesion between the pile and the low-friction layer is reduced so that water or the like enters through the ends and the long-term stability of the frost damage proofed pile is lost.

The frost damage proofed pile constructed by the combination of the above-mentioned requirements is usually installed by the following sequence of operations.

(1) The pile 10 is embedded in the bored hole 7 drilled through the active layer 6 and the permafrost layer 5 to the depth of embedment (h+H) of the pile 1 and the sand slarry 8 is back filled about the periphery of the pile 10.

(2) Where the strength of the permafrost layer 5 is relatively low or the pile 10 is embedded in the soil which has not frozen as yet, after the pile 10 has been embedded in the bored hole 7 drilled only into the active layer 6, the pile 10 is driven by a pile driver into the permafrost or the soil which has not frozen as yet and lastly the sand slarry 8 is back filled about the periphery of the pile 10 in the active layer 6.

While this embodiment is directed to the frost damage proofed pile as described above, a part of the functions and construction described so far may be utilized in applications for the prevention of frost damage to poles, fire hydrants, gas pipes and water supply pipes in a frigid area.

The results of tests carried in a refrigerating test chamber by using the conventional steel pipe as such and the frost damage proofed pile according to the present embodiment will now be described.

Figure 5:
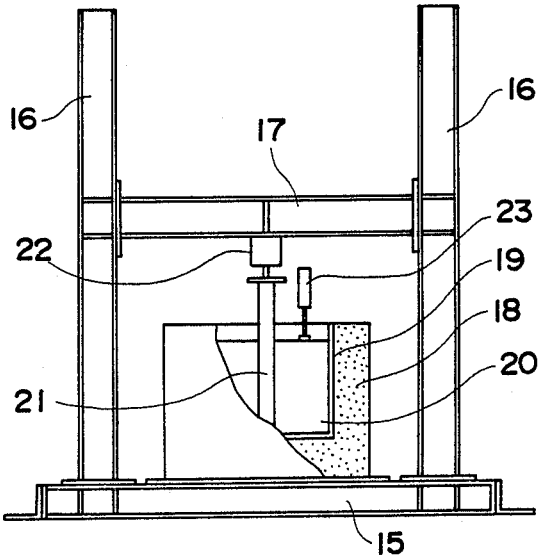
FIG. 5 is sectional view of a test device.

FIG. 5 shows the test device used in these tests.

The device is comprised of a pair of upright frames 16, 16 erected on a foundation 15, a reaction frame 17 interconnecting these frames, a soil vessel 19 placed on the foundation 15 and filled with soil 20, an insulation which is 100 mm in thickness and placed about the soil vessel 19, a model pile 21 located in the soil 20, a load cell 22 interposed between the model pile 21 and the reaction frame 17 and a displacement gage 23 designed for measuring a surface displacement of the soil 20 in the soil vessel 19.

TEST EXAMPLE I (1) Steel pipe pile (conventional) outer diameter, 34 mm; length, 400 mm; length of embedment, 250 mm (2) Frost damage proofed pile (corresponding to the embodiment shown in FIG. 4)

pile: The same as in (1)

Coverings:

A. Adhesion layer: polypropylene graft polymerized with acid anhydride (thickness, 0.2 mm, coated length, 300 mm)

Low-friction layer: mixture of 80 weight part of ethylene-propylene copolymer and 20 weight part of polytetrafluoroethylene powder having an average particle size of 10 μm (thickness, 0.8 mm; coated length, 300 mm)

B. Adhesion layer: modified silicone elastomer (thickness, 0.2 mm; coated length, 300 mm)

Low-friction layer: polytetrafluoroethylene (thickness, 0.8 mm, coated length, 300 mm).

The conventional steel pipe pile and the frost damage proofed pile according to this embodiment, as above described, were first installed in the respective devices shown in FIG. 5 and the test devices were then installed in the refrigerating chamber which was cooled from the room temperature to −40° C. and maintained for about 24 hours until the cooling was discontinued.

Figure 6:
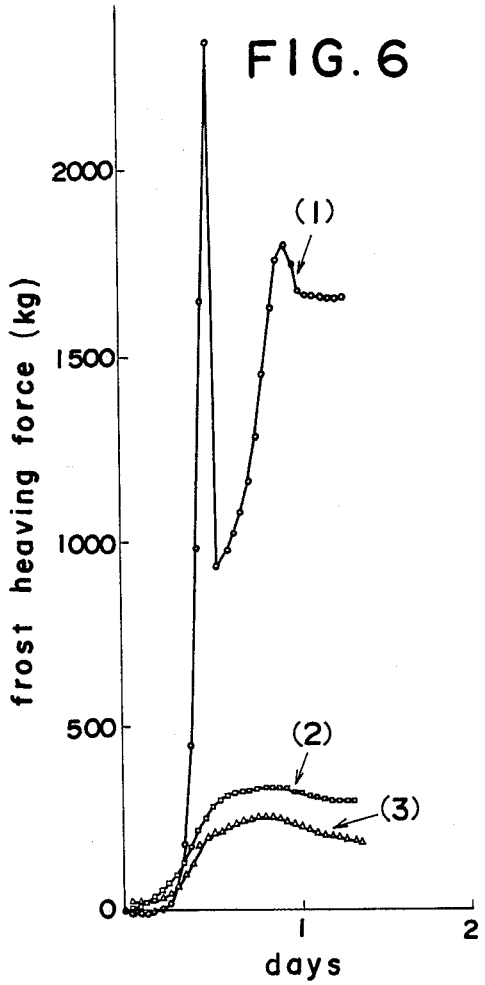
FIG. 6 is a graph showing different behaviours of the frost heaving force with the lapse of time in the first embodiment.

FIG. 6 shows the resulting changes with time in the frost heaving force as measured by the load cell 22 (in the Figure, (1) represents the test results on the conventional steel pipe pile and (2) and (3) the test results on the frost damage proofed piles according to the embodiment). As will be seen from the behaviours shown in the Figure, at −40° C., the frost heaving force for the steel pipe pile (1) is about −2400 Kg as compared with 250 to 350 Kg for the cases (2) and (3) of the frost damage proofed piles according to the embodiment, showing a considerable decrease over the case of the conventional steel pipe pile.

While, in the above-described embodiment, the present invention is applied to the ordinary steel pipe pile, the invention can also be applied to the conventional frost damage proofed piles (e.g., the adfreeze strength augmenting pile shown in FIG. 3).

Figure 7:
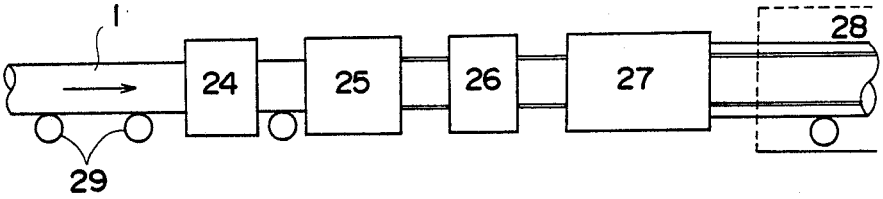
FIG. 7 is a front view showing an example of the manufacture of the frost damage proofed pile.

The frost damage proofed pile according to the present embodiment can for example be made in the following manner. (See FIG. 7).

(1) A steel pipe 1, subjected to the desired processing such as blasting or pickling, is transported in the lengthwise direction by supporting rolls 29, preheated in a steel pipe heating unit 24, coated with an adhesion layer 11 in a first coating zone 25, heated again as occasion demands, formed with a low-friction layer 12 containing polyfluoro-olefins or polytetrafluoroethylene powder in a second coating zone 27 and then cooled by cooling means 28.

The type of these coating zones can be selected as desired depending on the type of the material used. For instance, an extrusion coating method using a crosshead or a powder coating method by fluidized bed dipping may be thermoplastics and a fusion bonded powder coating method or a spray coating method may be used in the case of thermosetting plastics.

In the case of the extrusion coating, it is possible to form both an adhesion layer and a low-friction layer.

(2) A laminated tape comprising a low-friction layer consisting essentially of polyfluoro-olefins and an adhesive agent, e.g., modified silicone resin applied to the surface of the low-friction layer, is applied to the surface of a steel pipe subjected to the required treatment such as blasting or pickling.

The production of the frost damage proofed pile according to the present embodiment is not limited to the above-mentioned methods and the desired method may be suitably selected as occasion demands from among those means heretofore known in the art.

While this embodiment features the formation of two plastic coverings, i.e., an adhesion layer and a low-friction layer on the outer surface of a steel pipe, in order to prevent the occurrence of defects in the surface of the pile during transportation and installation, a protective coating may be applied to the outer covering or an intermediate layer of any other material may be provided between the adhesion layer and the low-friction layer from the standpoint of economy.

Figure 8:
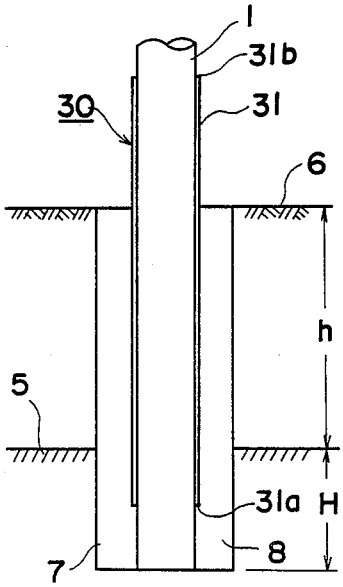
FIG. 8 is a sectional view of a frost damage proofed pile according to a second embodiment of the invention.

FIG. 8 shows a second embodiment of the invention. In the Figure, the numeral 1 designates a pile and a feature of this embodiment resides in that a plastic covering 31 having a glass transition temperature of 0° C. or over is smoothly applied to the surface of the pile 1 to extend beyond a length corresponding to the thickness (h) of an active layer 6.

In order to decrease the frost heaving force to a greater extent, as in the case of the first embodiment, the plastic covering 31 should preferably be applied in a manner that its lower end **31*a* is positioned near to or below the bottom region of the active layer or the seasonally frozen layer and its upper end 31*b*** is positioned above the ground surface.

It is to be noted that suitable materials for the plastic covering 31 include those whose glass transition temperatures are 0° C. or over and which can be applied as coverings to the surface of piles.

More specifically, these suitable materials include polyolefins such as polypropylene, propyleneethylene co-polymer and poly-4-methyl-1-pentene, thermoplastic polyesters such as polyethylene terephthatate and polybutylene terephthalate, polystyrene, polyhalo-olefins such as rigid polyvinyl chloride, polychlorotrifluoroethylene, etc., polyacrylates such as polyacrylic acid and polymethacrylic acid, polyacrylonitrile, polyphenylene oxide, polyphenylene sulfide, polyamides such as nylon 6 and nylon 6.6, polycarbonate thermosetting plastics such as aromatic polyester, epoxy resin, melamine resin, urea resin, phenole resin and polyurethane, polymer blends and composite materials essentially consisting of one or more of these materials.

If a material having a glass transition temperature of less than 0° C., e.g., low density polyethylene is used, repetition of the soil freezing and thawing cause flaws in the surface of the covering or cause earth and sand to get in the surface of the covering thereby increasing the actual surface area and the place of the physical coupling and failing to ensure a satisfactory frost heaving reducing effect. Thus, such materials cannot be used.

The surface of the plastic covering is smoothed for the same reason.

The frost damage proofed pile 30 constructed on the basis of the above-mentioned requirements can be installed by the same sequence of operations as mentioned previously. A comparison was made between the cases of the conventional steel pipe pile and the frost damage proofed pile according to the second embodiment was used in a refrigerating test chamber.

The tests were conducted by using devices of the type shown in FIG. 5.

TEST EXAMPLE II (1) Steel pipe pile (conventional)
Outer diameter, 34 mm; length, 400 mm; length of embedment, 250 mm (2) Frost damage proofed pile (corresponding to the embodiment shown in FIG. 8)
Pile: The same as in the above (1)
Covering material:
A: polypropylene, 2 mm (acid anhydride graft polypropylene, 0.2 mm, was used as an adhesive) Tg 20° C., coated length, 300 mm
B: polyethylene terephthalate, 2 mm (no adhesive was used)
Tg 80° C.; coated length, 300 mm (3) Comparison pile
Pile: The same as in the above (1) with an ethylene-propylene copolymer covering (2 mm; Tg −20° C.) of 300 mm long.

The conventional steel pipe pile, the frost damage proofed piles according to the second embodiment and the comparison pile were installed in the respective devices shown in FIG. 5. The devices were then placed in the refrigerating chamber which was cooled from the room temperature to −40° C. and maintained for about 24 hours until the cooling was stopped.

Figure 9:
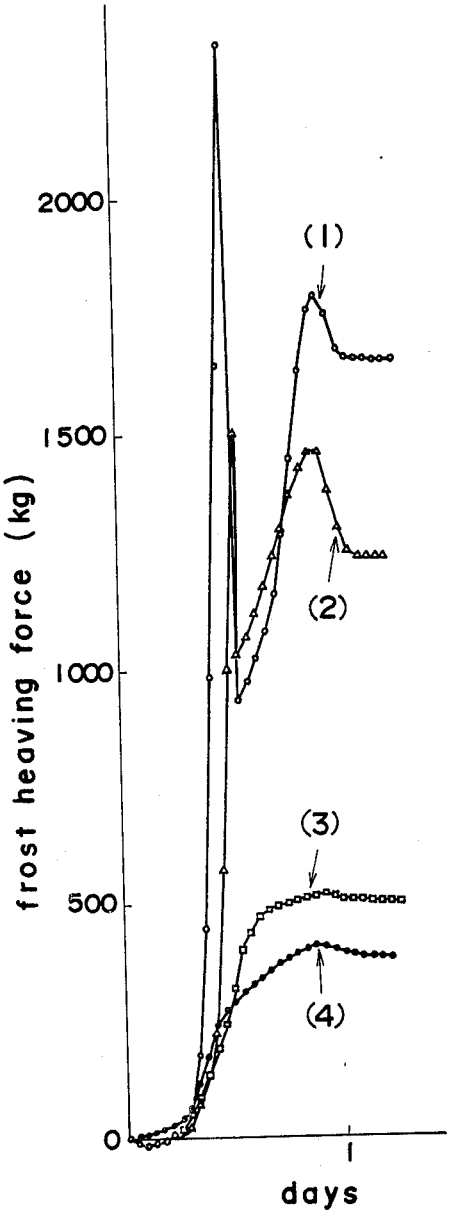
FIG. 9 is a graph showing different behaviours of the frost heaving force with the lapse of time in the second embodiment.

FIG. 9 shows the resulting changes with time in the frost heaving froce as measured by the load cell 22. In the Figure, represented by (1) are the test results on the conventional steel pipe pile, (2) the test results on the comparison pile and (3) and (4) the test results on the pile according to the invention.

As will be seen from the Figure, at −40° C., the frost heaving froce for the steel tube pile (1) is about 2400 Kg and those of the piles (2) and (3) according to the invention are 400 to 500 Kg. On the other hand, the frost heaving force for the conventional pile using the covering having a glass transition temperature of less than 0° C. is about 1500 Kg showing that the frost heaving force reducing effect is inferior.

While, in this test example, the invention is applied to the ordinary steel tube pile, the invention can also be applied to the conventional frost damage proofed piles (e.g., the adfreeze strength augumenting pile shown in FIG. 3).

In the manufacture of the frost damage proofed pile according to the second embodiment, if the pile is to be covered with a thermoplastic plastic, it is possible to use extrusion coating method from the crosshead having a tubular discharge nozzle and applying a covering to the steel tube in its lengthwise direction or a method of applying powdered plastic coating by fluidization dipping or fusion bonded coatings to the steel pipe heated preliminarily as occasion demands. Also, if a thermosetting plastic is to be used, the latter method or the spray coating process may be used.

While, in the present embodiment, the outermost covering is made of a plastic material having a glass transition temperature higher than 0° C., it is of course possible to apply a protective covering to its outer side to prevent the occurrence of flaws in the surface of the pile during transportation and installation of the pile.

Figure 10:
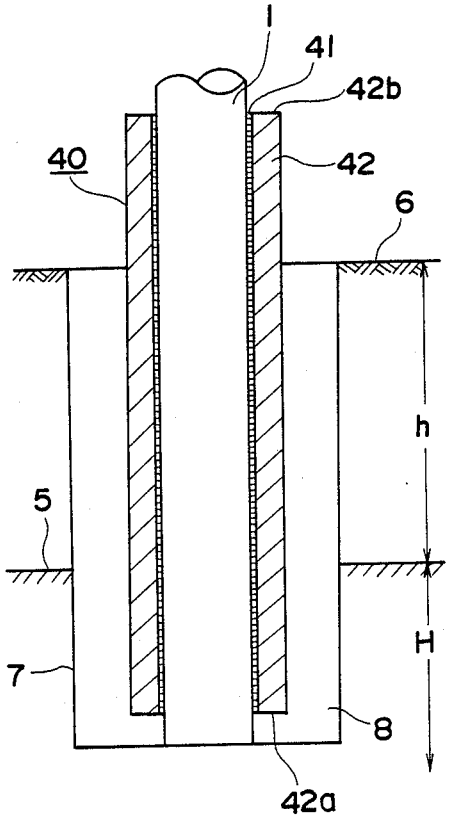
FIG. 10 is a sectional view showing a frost damage proofed pile according to a third embodiment of the invention.

FIG. 10 shows a third embodiment of the invention. In the Figure, the numeral 1 designates a pile whose surface is covered with an elastic material 42 through an adhesive material 41 as occasion demands beyond a length corresponding to the thickness (h) of an active layer 6.

In order to decrease the frost heaving force to a greater extent, the covering 42 should preferably be applied in such a manner that its lower end 42*a* is positioned near to or below the bottom region of the active layer 6 and its upper end 42*b* is positioned above the ground surface.

In this embodiment, the elastic covering 42 is one essentially consisting of an elastic material whose molecular chain has a net structure or a high molecular elastic material whose molecular main chain consists of soft and hard segments.

More specifically, suitable materials include natural rubber, isoprene rubber, styrene butadien rubber, butadiene rubber, chloroprene rubber, butyle rubber, ethylene rubber, ethylene diene rubber, chlorosulforated rubber, nitrile butadien rubber, fluorine rubber, nitroso rubber, polyester urethane rubber, polyether urethane rubber, silicone fluoride rubber, phenyl methylsilicone rubber, methylsilicone rubber, vinylsilicone rubber, polysulfide rubber, polyolefine elastomer, thermoplastic urethane rubber, thermoplastic polyamide elastomer, ethylene vinyl acetate copolymer, ethylene-ethylene acrylate copolymer, complex materials containing one or more of these materials (blends, copolymers, laminates, etc.) with or without inorgnic fillers.

The elastic covering 42 made of one of these materials must have an adhesive stress to the pile which is greater than a shear stress caused in the elastic material or a frictional force caused between the soil and the elastic material due to the frost heaving or the thawing subsidence of the soil.

For this purpose, the adhesion layer 41 must be formed as occasion demands.

The elastic coating 42 firmly adhered to the pile 1 absorbs through its elastic deformation the shear stress caused in the pile by the frost heaving of the soil and it also restores the initial state with a relatively small force owing to its stress relaxation properties and elastic recovery properties at low temperatures.

Thus, the elastic covering 42 can withstand large deformation of the soil and it is usable over a long period of time.

It is to be noted that with E representing the elastic modulus of the elastic covering 42 and t its covering thickness, the shear stress $\tau$ developed between the soil and the pile due to the up and down movements of the soil has the following relation $$\tau \propto E/t$$

and therefore the elastic covering 42 should preferably be low in elastic modulus and large in thickness.

Since the frost damage proofed pile according to the third embodiment is constructed as shown in FIG. 10 and the outermost layer consists of the elastic covering 42, a protective covering may be applied to the outer side of the elastic covering 42 to prevent the occurrence of damage to the pile during its transportation and installation at the construction site.

In this case, the protective covering needs not always be adhered to the elastic covering 42 and also it needs not be removed when embedding the pile.

Where a thermoplastic plastic is used for an elastic covering 42 in the production of a frost damage proofed pile according to the invention , it is possible to use a method of extruding the plastic in molten state from a cross-head die having a tubular discharge nozzle and coating the steel pipe pile in its lengthwise direction.

Also, where a crosslinked elastomer is used, it is possible to use for example a method in which the elastomer is extruded into a band form in its uncrosslinked state, wrapped on the rotating steel pipe pile to form a covering of the desired thickness and then subjected to the process of crosslinking by means of heating or the like.

The frost damage proofed pile 40 constructed on the basis of the above-mentioned requirements can usually be constructed by the previously mentioned sequence of operations.

A description will now be made of the results of field tests conducted by placing the conventional steel pipe pile and the frost damage proofed pile according to first, second and third embodiments.

Figure 11:
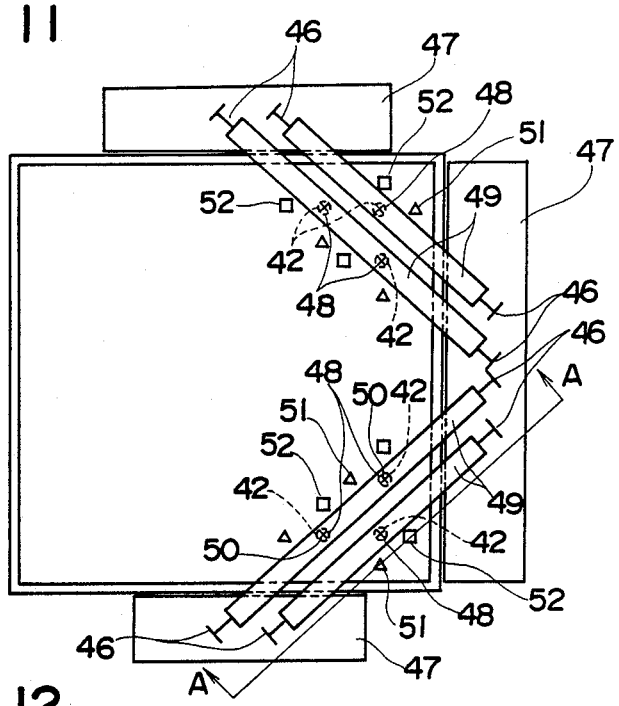
FIG. 11 is a plan view of the test device used with the third embodiment.
Figure 12:
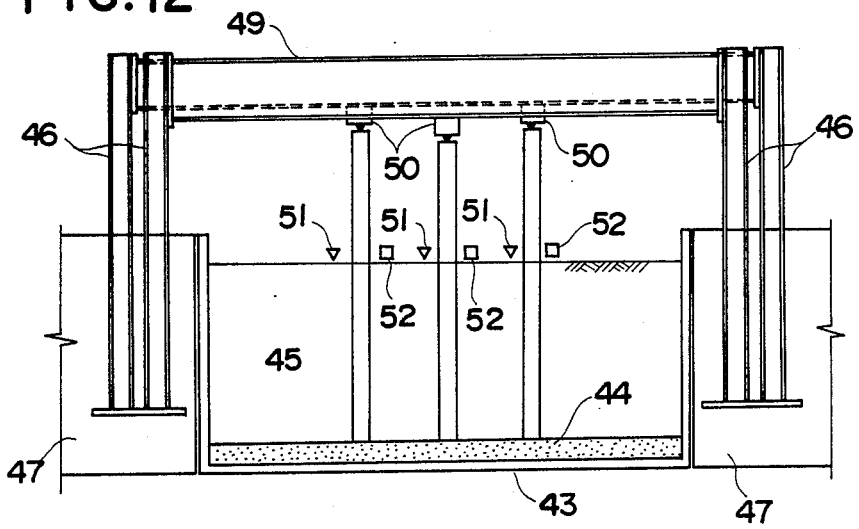
FIG. 12 is a view looked in the direction of the arrow lines A—A of FIG. 11.

The device shown in FIGS. 11 and 12 was used in the tests and the Figures schematically show the case in which the model piles having firmly adhered coverings were subjected to outdoor frost heaving force measurements in the Hokkaido district.

In the Figures, the numeral 43 designates a soil vessel made of concrete having a width equal to 5000 mm, a length equal to 5000 mm and a depth equal to 2000 mm and the soil vessel 43 contains a gravel layer 44 deposited to a thickness of 200 mm on the bottom within the soil vessel 43 to form a foundation layer and silty soil 45 having frost heaving properties and filled to a thickness of 1700 mm on top of the gravel layer 44.

The soil vessel 43 is embedded in a bored hole in the existing ground and the upper end face of the soil vessel 43 is on the same level with the surface of the existing ground.

The numeral 46 designates H-beam frames embedded in concrete foundations 47 to erect therefrom, and after model piles 48 have been embedded in the silt layer 45, reaction frames 49 are extended over the model piles 48. Load cells 50 are arranged between the model piles 48 and the reaction frames 49 and also displacement gages 51 for measuring ground surface displacement and frost line measuring pipe 52 for measuring the frost depth from the ground surface are set in place.

TEST EXAMPLE III (1) Steel pipe pile (conventional)
Outer diameter, 60.5 mm; length, 2500 mm; length of embedment, 1800 mm.

(2) Frost damage proofed pile (corresponding to the first embodiment in FIG. 4)
Pile: The same as in (1)
Covering materials: Polytetrafluoroethylene 0.8 mm (modified silicone elastomer (0.2 mm) was used as an adhesive). Coated length: 2000 mm (3) Frost damage proofed pile (corresponding to the second embodiment in FIG. 8)
Pile: The same as in (2)
Covering materials: polypropylene: 2 mm (acid anhydride graft polypropylene (0.2 mm) was used as an adhesive)
Coated length: 2000 mm;

(4) Frost damage proofed pile (corresponding to the embodiment shown in FIG. 10)
Pile: The same as in the above (1)
Elastic covering:
A: chloroprene rubber coating thickness, 30 mm; coated length, 2000 mm; urethane adhesive was used
B: thermoplastic polyolefin elastomer coating thickness, 20 mm; coated length, 2000 mm; modified polyolefin was used as an adhesive The conventional steel tube pile (1) and the frost damage proofed piles (2)A and B according to the invention were set in the respective devices shown in FIGS. 11 and 12 and the resulting changes with time in the displacement of the soil and the frost heaving force were measured. The resulting maximum, the resulting frost heaving amount of the soil was about 250 mm and the resulting maximum frost heaving forces were as shown in the following table.

| Type of Pile | Frost heaving force (Kg) |
|---|---|
| (1) | 2500 |
| (2) | 250 |
| (3) | 280 |
| (4) | |
| A | 370 |
| B | 530 |

It is seen from the table that the pile (2), (3)A, (4) and (4)B decrease the frost heaving force to as low as 1/50 to 1/10 of that for the conventional pile (1).

While, in this test, the invention is applied to the piles (2) comprising the ordinary steep pipe piles, it can of course be applied to the conventional adfreeze strength augumenting piles such as shown in FIG. 3.

Figure 13:
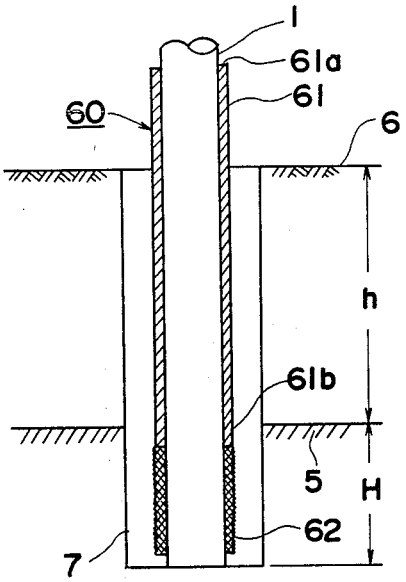
FIG. 13 is a sectional view of a frost damage proofed pile according to a fourth embodiment of the invention.

FIG. 13 shows a fourth embodiment of the invention. In the Figure, the numeral 1 designates a pile, and 61 and 62 plastic solid coverings adhered over the whole lengths thereof to the outer surface of the pile 1.

The covering 61 is formed to have a smooth surface for a length greater than the thickness h of an active layer 6 and the low friction characteristic of its surface is utilized to ensure the effect of reducing the shearing force acting on the pile due to the frost heaving and subsidence displacements of the soil.

The covering 61 is disposed in such a manner that its upper end 61*a* is positioned above the ground surface and its lower end 61*b* is positioned near to or below the bottom region of the active layer 6.

On the other hand, the covering 62 is a plastic solid covering which is arranged continuously or discontinuously below the covering 61 and whose surface is formed with irregular projections and depressions and it has the effect of increasing the adfreeze strength and bearing capacity of the pile in the permafrost.

The material of the covering 62 may be the same or different from that of the covering 61.

Figure 14:
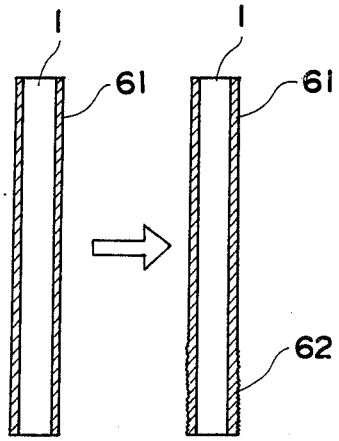
FIG. 14 shows an exemplary manner in which the lower part of the plastic covering is formed with a rugged surface by a post processing.
Figure 15:
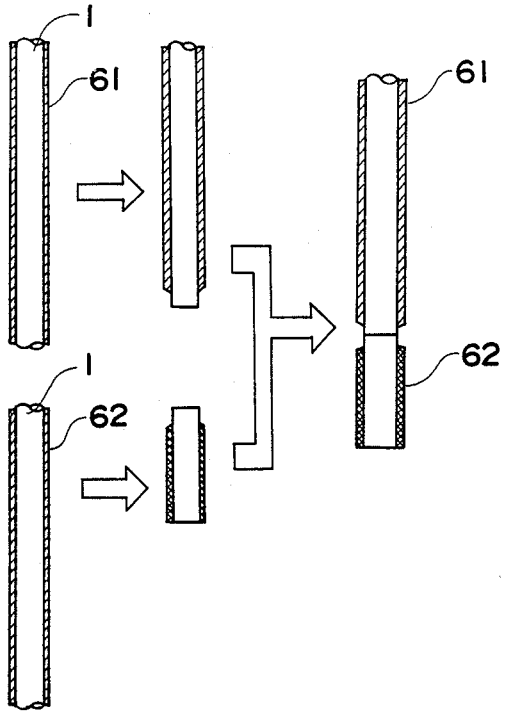
FIG. 15 shows an exemplary manner in which a rugged portion is provided by a joining method.

In the case of the former, it is conceivable to use a method of forming a smooth covering 61 over the whole length of the pile and then forming irregular projections and depressions only on its portion corresponding to a covering 62 as shown in FIG. 14 or a method of cutting separate piles respectively formed with coverings 61 and 62 to suitable lengths and joining the lengths by welding or any other given means as shown in FIG. 15.

Figure 16:
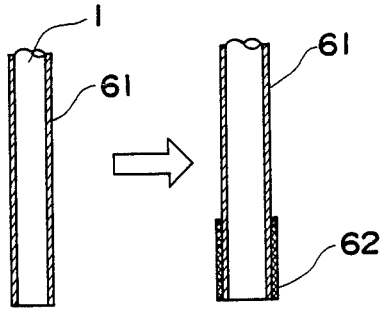
FIG. 16 shows an exemplary manner in which a rugged portion is provided by fitting a separate steel tube of a slightly larger diameter.

Still other methods are conceivable including a method of forming a smooth covering 61 on the surface of a pile except its lower portion or all over the whole length and then forming an additional covering 62 on the lower portion of the pile and a method of placing and securing a tubular member or members corresponding to the covering 62 onto the outer side of a pile as shown in FIG. 16.

It is to be noted that the coverings 61 and 62 must be closely adhered to the pile and the adhesion force must be greater than the frost heaving strength $\tau$ between the soil and the covering 61. Also, the adhesion force $\tau'$ of the covering 62 must have a magnitude given by $\tau \geqq \tau \times (h/L)$ (where h is the active layer thickness and L is the length of the covering 62 in the permafrost).

If these adhesion forces are not ensured, the alternate freezing and thawing of the soil over a long period of time causes a displacement between the coverings and the soil and leads to a deterioration in the frost damage reducing effect.

The frost damage proofed pile 60 constructed in this way can usually be installed by the sequence of operations as mentioned previously.

The construction and effects of the frost damage proofed pile according to the fourth embodiment will now be described in detail with reference to the results of tests conducted.

TEST EXAMPLE IV

The measurement of frost heaving force was made by using test devices of the type shown in FIG. 5.

TEST MATERIALS (1) Steel pipe pile (conventional) Outer diameter, 34 mm; length, 400 mm; length of embedment, 250 mm
(2) Frost damage proofed pile (corresponding to the embodiment shown in FIG. 13)
Pile: the above-mentioned steel tube pile
Coverings: polypropylene (coating thickness, 1.0 mm) acid anhidride graft polypropylene was used as an adhesive material to a coating thickness of 0.2 mm
Coated length: 300 mm The conventional steel pipe pile and the frost damage proofed pile according to the present embodiment, as above described, were embedded in the respective test devices and the test devices were placed in a refrigerating chamber which was in turn cooled from the room temperature to −40° C. and maintained for about 24 hours until the cooling was stopped.

Figure 17:
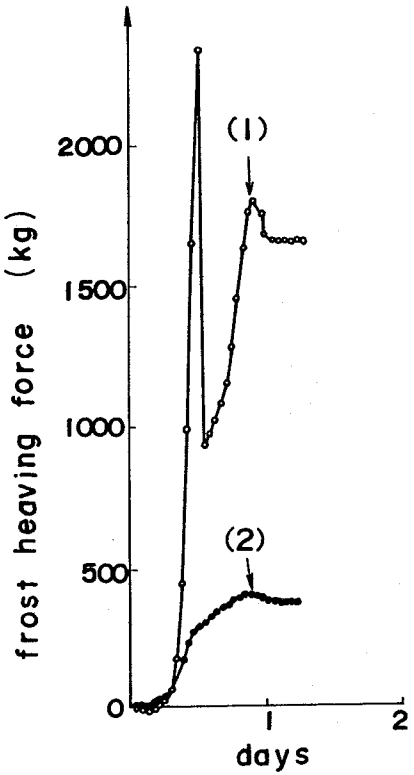
FIG. 17 is a graph showing different behaviours of the frost heaving force with the lapse of time in the fourth embodiment.

The resulting frost heaving forces as measured by the load cells 20 are shown in FIG. 17 (in which (1) designates the conventional steel pipe pile and (2) the frost damage proofed pile according to the invention). From these behaviours it will be seen that at −40° C., the frost heaving force for the steel pipe pile (1) is about 2400 Kg and that for the steel pipe pile (2) is about 400 Kg showing a considerable reduction.

TEST EXAMPLE V

Figure 18:
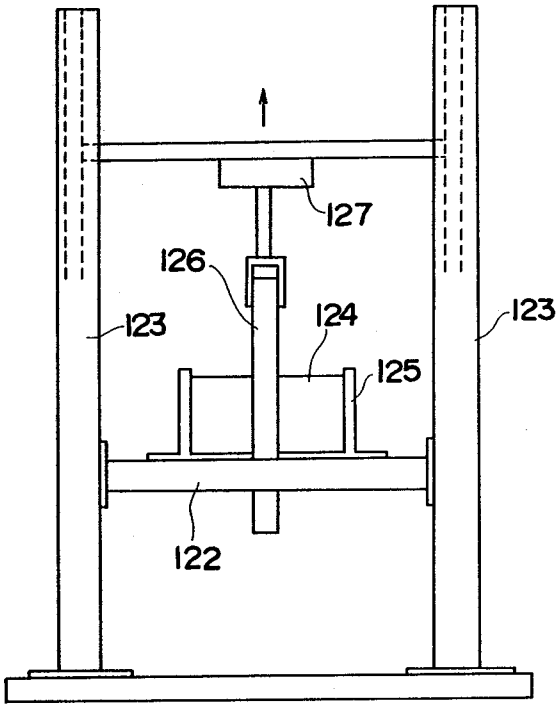
FIG. 18 is a sectional view of a test device.

Pull-out tests were conducted on the pile 60 by using the device shown in FIG. 18.

The device includes a foundation 122 extended between a pair of frames 123, 123, a soil vessel 125 filled with silt soil 124 and arranged on the foundation 122 and a model pile 126 embedded in the soil 124.

MODEL PILES (1) Smooth covering pile (comparison pile)
pile: outer diameter, 34 mm
covering: polypropylene (coating thickness, 1.0 mm) modified polypropylene of 0.2 mm thick was used as an adhesive material
(2) Rugged covering pile (corresponding to the embodiment of FIG. 13 having the rugged coating 62)

This pile was obtained by pressure embossing the outer surface of the covered pile shown in the above (1) in the course of its manufacture.

The model piles prepared in these manners were embedded in the respective test devices to a depth of 100 mm, left to stand at −10° C. for 72 hours in a low temperature vessel and then pulled out from the soil vessels thereby conducting the tests.

The resulting pull-out shear stresses in the test piles (1) and (2) were measured with the result that the values for the pile (1) were in the range of 2 to 5 $Kg/cm^2$ and the values for the pile (2) ranged from 40 to 50 $Kg/cm^2$ showing that the frost damage proofed pile according to the invention had a very large adfreezing strength.

We claim:

1. A frost damage proofed pile comprising:
a pile member,
a smooth-surfaced plastic covering member having a low coefficient of friction and being formed on an outer surface of said pile member, integral with said pile member, to surround a predetermined length of said pile member for reducing a frost heaving force or negative friction acting on said pile member when said covering member is in contact with frozen soil in a frigid area, and
adhesion means for closely adhering said covering member to said pile outer surface within said predetermined length to a degree greater than a shear stress generated on said outer surface by said frozen soil.

2. A frost damage proofed pile according to claim 1, wherein said predetermined length is between 0.5 and 5 m.

3. A frost damage proofed pile according to claim 1, wherein said covering member has a relatively low coefficient of friction containing one percent by weight or more of polytrifluoroethylene or polytetrafluoroethylene.

4. A frost damage proofed pile according to claim 1, wherein said covering member has a glass transition temperature of 0° C. or over.

5. A frost damage proofed pile according to claim 1, wherein said covering member comprises an elastic material.

6. A frost damage proofed pile according to claim 5, wherein the molecular chain of said elastic material has a net structure.

7. A frost damage proofed pile according to claim 5, wherein said elastic material essentially consists of a high molecular elastic material whose main chain comprises hard and soft segments.

8. A frost damage proofed pile according to claim 1, further comprising an adhered covering member having a rugged surface and arranged below said smooth-surfaced covering member.

9. A frost damage proofed pile according to claim 8, said rugged-surface covering member is made integral with said smooth-surfaced covering member.

10. A frost damage proofed pile according to claim 8, wherein a separate pile member having said rugged-surface covering member thereon is connected to said pile below said smooth-surfaced covering.

11. A frost damage proofed pile according to claim 8, wherein said rugged-surface covering member is formed on the surface of a portion of said smooth-surfaced covering.

* * * * *